US009850786B2

(12) United States Patent
Millen

(10) Patent No.: US 9,850,786 B2
(45) Date of Patent: Dec. 26, 2017

(54) CAM PHASER LOCKOUT KIT AND METHOD

(71) Applicant: Livernois Motorsports & Engineering, LLC, Dearborn Heights, MI (US)

(72) Inventor: Dan Millen, New Boston, MI (US)

(73) Assignee: LIVERNOIS MOTORSPORTS & ENGINEERING, LLC, Dearborn Heights, MI (US)

( * ) Notice: Subject to any disclaimer, the term of this patent is extended or adjusted under 35 U.S.C. 154(b) by 360 days.

(21) Appl. No.: 14/568,500

(22) Filed: Dec. 12, 2014

(65) Prior Publication Data

US 2016/0169059 A1 Jun. 16, 2016

(51) Int. Cl.
*F01L 1/344* (2006.01)

(52) U.S. Cl.
CPC ... *F01L 1/3442* (2013.01); *F01L 2001/34476* (2013.01)

(58) Field of Classification Search
CPC ..... B23P 6/00; Y10T 29/49716; Y10T 29/49718; Y10T 29/49721; Y10T 29/49758; Y10T 29/49764; Y10T 29/49799; Y10T 29/49861; Y10T 29/49895; Y10T 29/49899; F01L 1/3442; F01L 2001/34476
USPC ..... 33/533, 600, 601, 605, 645; 123/90.32
See application file for complete search history.

(56) References Cited

U.S. PATENT DOCUMENTS

| | | | | |
|---|---|---|---|---|
| 4,373,240 | A * | 2/1983 | Castoe | B25B 27/0035 269/50 |
| 5,755,029 | A * | 5/1998 | Learned | B25B 27/0035 29/402.03 |
| 6,840,202 | B2 * | 1/2005 | Simpson | F01L 1/022 123/90.15 |
| 8,413,326 | B2 * | 4/2013 | Iwagami | F01L 1/02 123/90.15 |
| 2007/0056538 | A1 * | 3/2007 | Simpson | F01L 1/3442 123/90.17 |
| 2012/0317807 | A1 * | 12/2012 | Vukovich | F01L 1/3442 29/888.01 |

* cited by examiner

*Primary Examiner* — Jason L Vaughan
*Assistant Examiner* — Amanda Meneghini
(74) *Attorney, Agent, or Firm* — Fulwider Patton LLP

(57) ABSTRACT

A method for reducing noise in an engine is disclosed whereby a camshaft phaser is modified by a lockout to limit the movement of the phaser during operation. The lockout is inserted into the phaser's gear without removing the front engine cover using a novel method.

9 Claims, 5 Drawing Sheets

FIG. 5
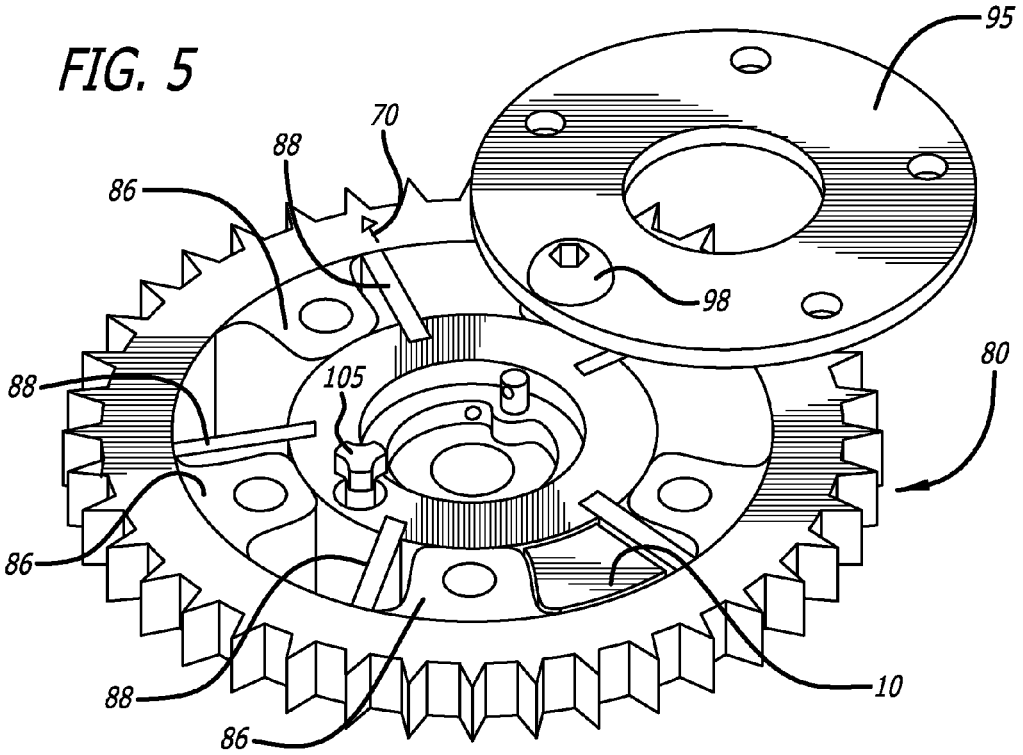
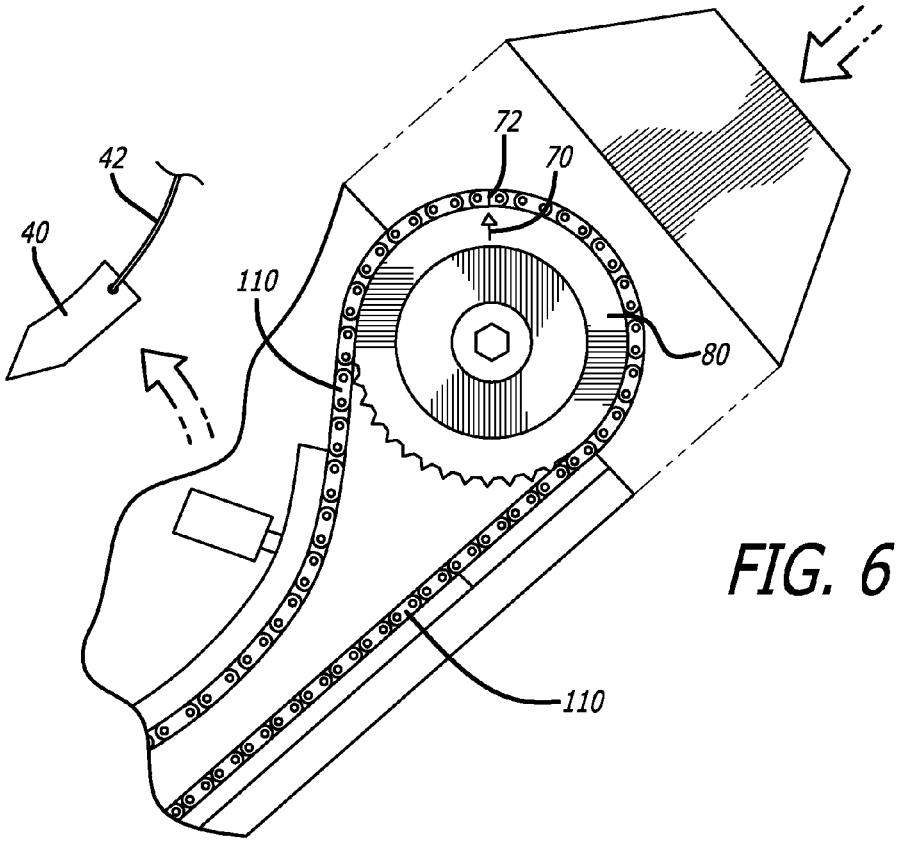
FIG. 6

CAM PHASER LOCKOUT KIT AND METHOD

BACKGROUND

Modern day automobile engines have become sophisticated machinery controlled by computers to handle virtually all aspects of the operation of the vehicle. In recent years, the control over various aspects of the engine have increased to the point where almost every movement or operation of the engine is governed or monitored by a computer. The present invention relates to a particular aspect of the engine's operation under the control of the vehicle's onboard computer, or engine control unit ("ECU").

One key characteristic of a vehicle's engine is the power generated by the engine, which is a function of the degree and extent that the intake and exhaust valves open, how long the stay open, and the timing of when they open and close. If the valves open slightly longer and/or a slightly later in the ignition cycle, or if they are opened for a prolonged portion of the cycle, the engine will exhibit a distinct muscle-car rumble with an accompanying high-rpm horsepower. Conversely, reducing the opening of the valves and opening them slightly earlier results in a smoother engine percussion with a steady idle, good low-rpm torque, superior fuel economy and lower emissions. Traditionally, the control of the valve movements and timing in all aspects have been controlled by a camshaft with carefully calibrated lobes that pushed the valves open at exactly the right time and maintain the opening for the desired duration.

In today's engines, camshaft phasers play an important role in a key aspect of the cam timing: the camshaft's position relative to the crankshaft, and thus the position of the pistons connected to it. If one advances or retards the cam slightly relative to the crankshaft, the valves will open and close sooner (or later) relative to the piston coming up in the bore. When the cam advances earlier, the engine will sound smoother but will lack top end horsepower. "Retarding" the cam, i.e., turning it so the valves open and close late, is better for horsepower but results in what some consider to be an overly loud, disruptive noise (albeit one that some vehicle owners prefer). Traditionally, engine manufacturers set a certain amount of cam advance or retard while designing the engine. This could be accomplished by moving the whole cam sprocket gear one tooth forward or backward on the timing chain, or through aftermarket adjustable sprockets that could be rotated relative to the camshaft's original position.

A cam phaser is an adjustable camshaft sprocket mounted on the chain, and can be turned by means of a computer-controlled solenoid. Rather than pre-setting a certain amount of advance or retard, the computer can advance the cam or cams in situ at low rpm to enhance driveability, and retard the cam or cams at high rpm for more horsepower. Cam phasers may be specially designed for a particular engine, and computer-controlled cam gears for specific engines have the ability to adjust camshaft position (and thus valve opening and closing) while the engine is running. In the case of Ford modular engines that use two camshafts, two cam phasers are used. To actuate the cam phaser, engine oil is pressure fed to the cam phasers through a series of passageways in the cylinder heads and camshafts. The engine computer controls a pair of solenoids that adjusts this oil flow into and out of the cam phaser's control chambers, giving the ability to retard the cams in some cases up to 60 degrees or crank rotation.

When the cams are retarded approximately 20-40 degrees during part throttle engine operation, it takes less power to turn the engine over. This helps to increase the engine's fuel efficiency. Another power benefit is that the cam phasers allow the camshafts to always be in the optimal position for maximum power, regardless of what the engine's rpm is. The engine thus in able to generate more torque and horsepower and extends the high rpm powerband by, in some cases, an extra 800-1000 rpm.

However, one downside of stock cam phasers it is that they are exceptionally sensitive to changes, specifically the reduction of, oil pressure. Since the cams can theoretically be retarded by up to 60 degrees, when an issue arises, it causes the cam phaser to no longer have controlled movement. This can cause "knocking" or excessive engine noise if there is interference between the cam and the piston. This minimal piston to valve clearance also limits most engines to fairly small cam profiles with very little overlap. Thus, a solution is needed to address the issue of excessive movement with inadequate clearance due to the wide range of movement resulting from the camshaft phaser. In addition to this, the rapid, and violent action of the cam phaser moving from each end of the mechanical limit without control can cause the cam phaser to separate from the camshaft causing severe engine damage.

SUMMARY OF THE INVENTION

The present invention is a camshaft phaser noise repair kit and method that, when combined with a recalibration of a vehicle's onboard computer, allows for a reliable, economical repair of an engine's variable camshaft timing phaser. The mechanical elements of the present invention physically limit the movement of the camshaft phasing when installed in the camshaft, reducing the volume of oil needed for camshaft phasing adjustment. The elements also limit the total travel rotation of the phaser, which eliminates or reduces the failure of the phaser system and prevents engine damage while reducing noise. The camshaft phaser uses engine oil pressure to hydraulically control the camshaft phasing. Over time, normal engine wear causes a reduction in supplied oil pressure, specifically at idle, and the result is a loss of control of the camshaft phasing. This loss of control can lead to engine failure if not addressed as the internal pieces of the camshaft phaser impact as a result of a lack of oil pressure. The repair kit of the present invention avoids costly dealer repairs and can be installed by the vehicle owner economically, and the fix permanently limits the camshaft phasing so as to implement a one time repair.

The kit of the present invention includes a lockout component that is inserted into the phaser. Made from a high strength material such as 6061-T6 billet aluminum, the mechanical lockouts fit directly inside the factory-installed cam phaser with no further modifications necessary. These lockouts also prevent failure in the cam phaser when using aftermarket springs that use increased force when compared with stock springs, allowing for the use of aftermarket camshaft profiles. By locking the factory cam phaser, the engine can use higher duration and lift camshafts that would otherwise cause issues with the piston to valve relationship. The lockout completely precludes the phaser from moving, which allows for greater durability in applications where the cam phaser might be more prone to failure in racing environments with aftermarket springs and camshafts.

To implement the new settings with the lockouts installed, the engine control unit is reflashed with a kit included programmer that allows for proper engine calibration with the updated, limited range in camshaft phasing. The ability to update the ECU via a remote database, such as by accessing the internet, allows a user the opportunity for quick and inexpensive access to appropriate recalibration datasets needed for newer or unknown factory calibrations that the OEMs may have released after the device is installed. For example, when transferring files from the update server to the programmer connected to the ECU, the internet update applications acts as a simple pass through application to communicate or exchange the data. The update server determines the proper files needed by the programmer that matches the calibration data currently used in the vehicle, and encrypts the files via a propriety encryption scheme using an encryption key known only to the programmer and update server. The programmer receives the encrypted data and decrypts the files using this encryption key. The encryption key is preferably a dynamic random key that is regenerated each time the programmer establishes communications with the update server via the update application.

BRIEF DESCRIPTION OF THE DRAWINGS

FIG. 5 is a perspective view, partially exploded, of the phaser with the lockout installed;

FIG. 6 is an elevational, cross sectional view of the chain after the wedge tool is removed;

DETAILED DESCRIPTION OF THE PREFERRED EMBODIMENTS

For certain vehicles, the most common failure or issue with the engine is the cam phaser, and specifically cam phaser knock. Cam phaser knock usually results in the eventual failure of the cam phaser due to excessive movement, which causes the pin in the phaser to fracture the housing of the phaser, and in extreme cases the entire assembly can fail and damage the engine. The present invention addresses this problem by ensuring that the cam phasers do not suffer premature failure. It will reduce or eliminate any knocking noise heard from the front valve cover/timing cover area related to the phasers. The present invention comprises a cam phaser lockout kit and method for updating a Ford modular engine using the same. The kit is an engine modification that permanently modifies the camshaft phaser and uses a recalibration to adjust the engine's timing in accordance with the changes to the phaser.

Figure 1:
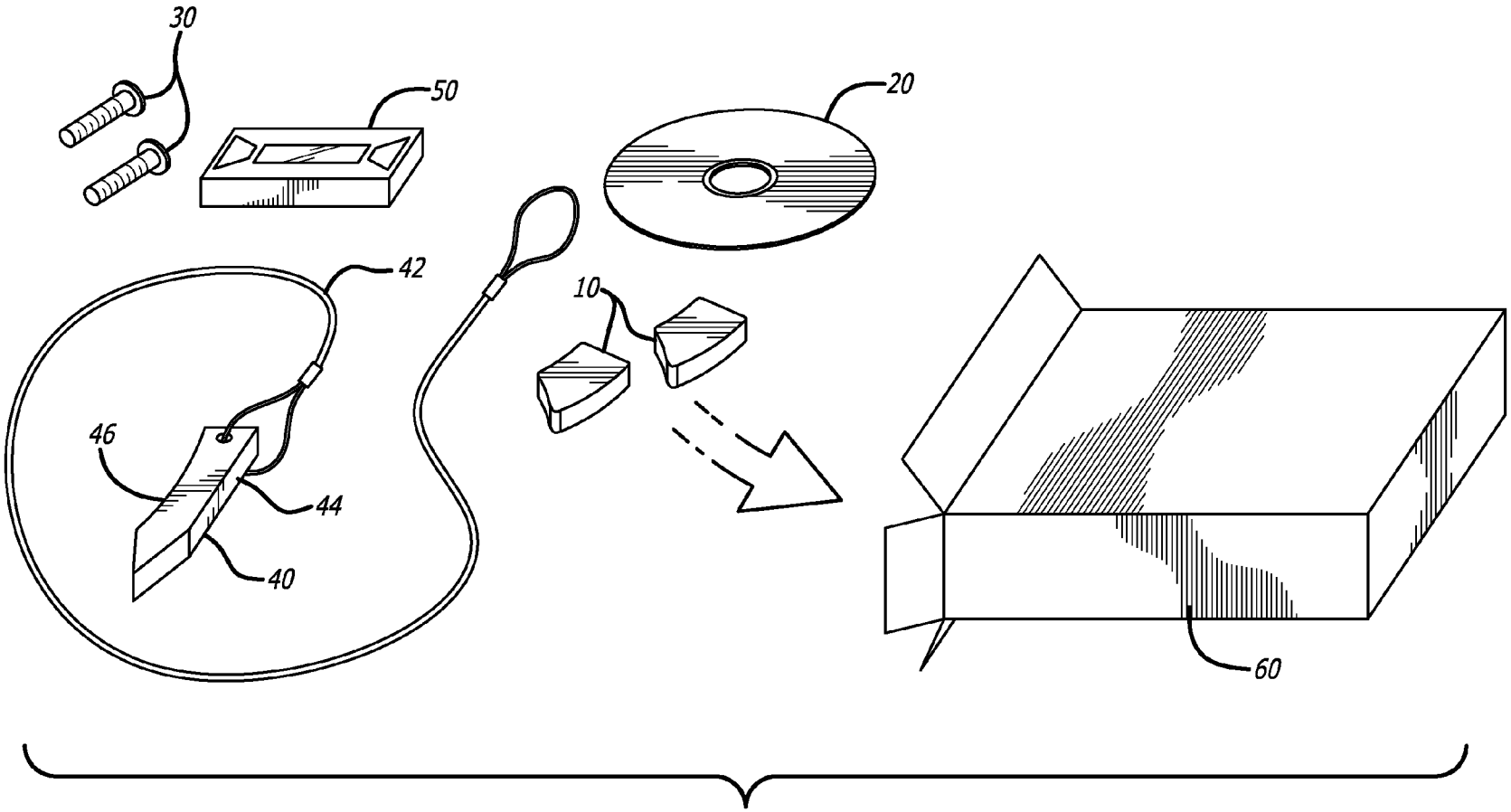
FIG. 1 is a perspective view of a kit embodying elements of the present invention.

FIG. 1 illustrates the components of the kit, including two mechanical lockouts 10, a data storage device 20 such as a CD-ROM, camshaft phaser bolts 30, a wedge tool 40 including a tether or cable 42, and a programmer 50, which can all be shipped in a shipping container 60 for ease of delivery. To implement the method and kit of the present invention, a synopsis of the complete installation will be set forth below.

To install the phaser repair kit, the vehicle's battery is first disconnected and all of the components necessary to access valve covers are removed. Once all other components are removed, the valve covers are removed although the front cover can be left in place.

Figure 2:
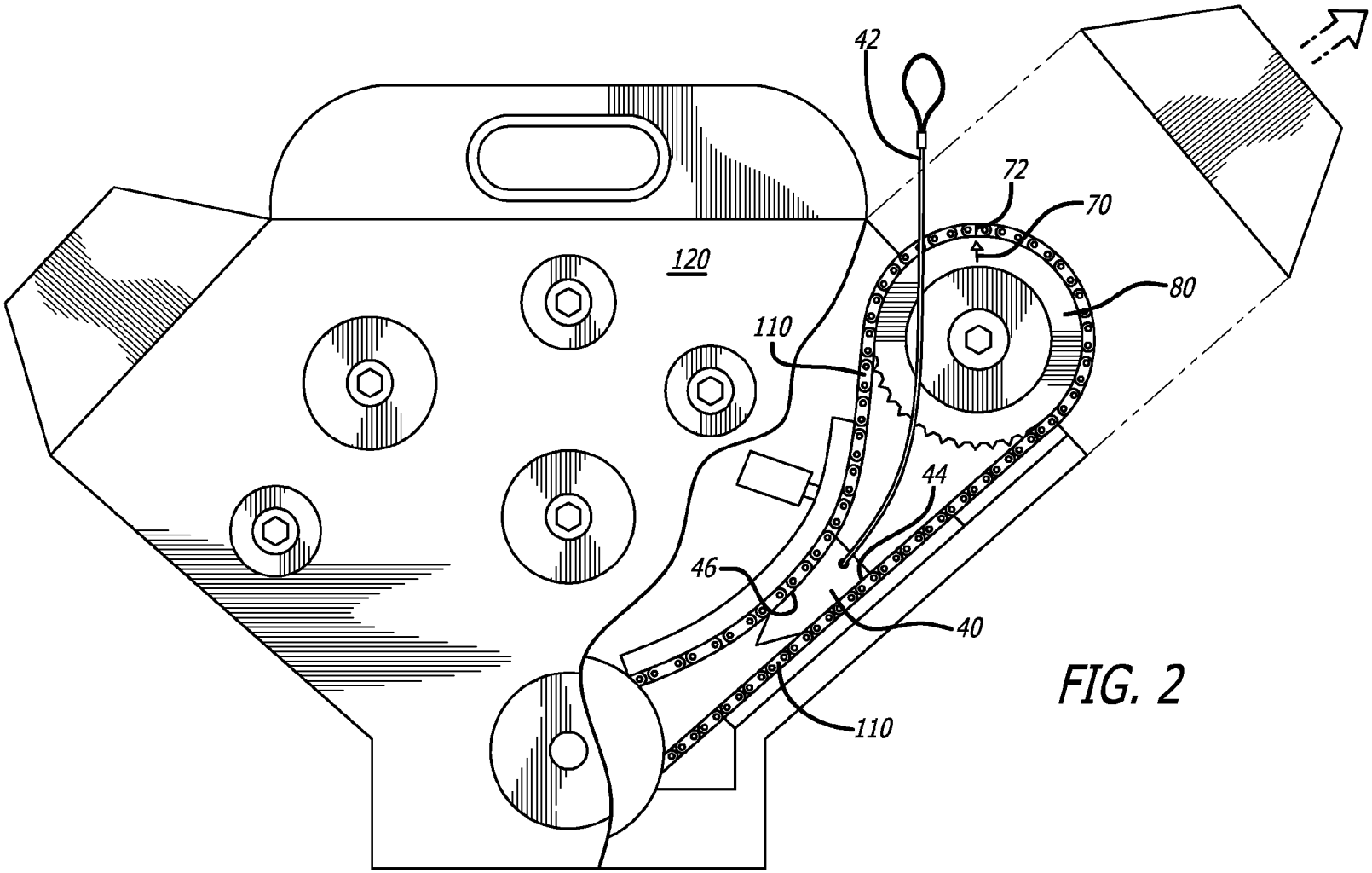
FIG. 2 is an elevational view, partially cut-away, showing the position of the wedge tool and chain.

The kit includes a timing chain wedge tool 40, shown in FIG. 1. The first step is to carefully fix the timing chains while the phaser is modified. The wedge tool allows for locking of the timing chains 110 on a vehicle without having to remove the front cover 120. Once the valve covers are removed, the wedge tool 40 is dropped into position between the chains 110 (FIG. 2), and a long screwdriver or similar tool can be used to further drive the wedge tool 40 into a tightly wedged position between the chains 110, effectively immobilizing the timing chains. The wedge tool includes a small notch in the top surface to allow a tool such as the screwdriver to be used to push the piece into place. The immobilization of the timing chains 110 can be verified by using a light tugging on the wedge tool's cable 42 to ensure that the wedge tool is firmly engaged with the chains 110. The wedge tool 40 has two sides, one flat 44 (which goes up against the fixed guide) and one 46 with a curve to it (which goes up against the pivoting guide). The shape of the wedge tool 40 allows it to engage the chains 110 without being pushed all the way through the chains. Once the wedge tool 40 into place, the pull cord 42 is left hanging out of the top of the engine so that once the repair is complete, the cord may be pulled swiftly to dislodge the wedge and allow it to be easily removed.

Once the wedge tool 40 is firmly in place, one of the sections of chain is paired with a tooth on the phaser 80 using, for example, a mark 70 on the phaser from a felt pen and a mark 72 on the chain from a felt pen. These alignment marks ensure that the phaser 80 is returned to the exact same orientation that it occupied originally.

Figure 3:
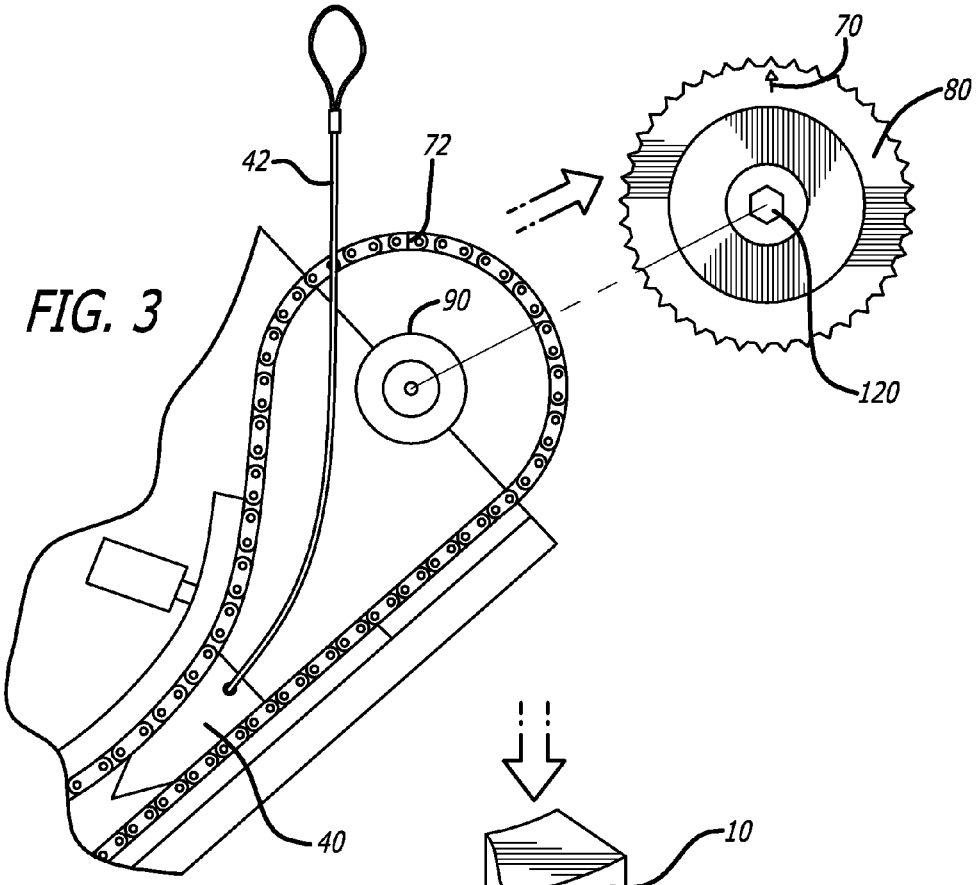
FIG. 3 is an elevational view, partially exploded, of the cam phaser and cam shaft.

Once the wedge tool 40 is in place and the alignment markings are made, the large camshaft bolt 120 holding the phaser 80 to the camshaft 90 is removed and the camshaft phaser 80 is removed (FIG. 3).

The next step is to insert the lockout 10 into the phaser 80. The phaser is secured in a vice to hold the assembly in place as the bolts are removed to release the cover 95. It is preferable to remove four of the five bolts holding the phaser together and loosen the remaining long bolt. One of the long bolts goes through the assembly and comes out the other side where it holds the spring for the phaser assembly in tension. This bolt will be left in place and only loosened to allow the rear cover 95 to rotate out of the way. After the bolts are loosened, one can remove the phaser assembly from the vice and place it on a workbench, where the remaining bolts can be removed by hand.

Figure 4:
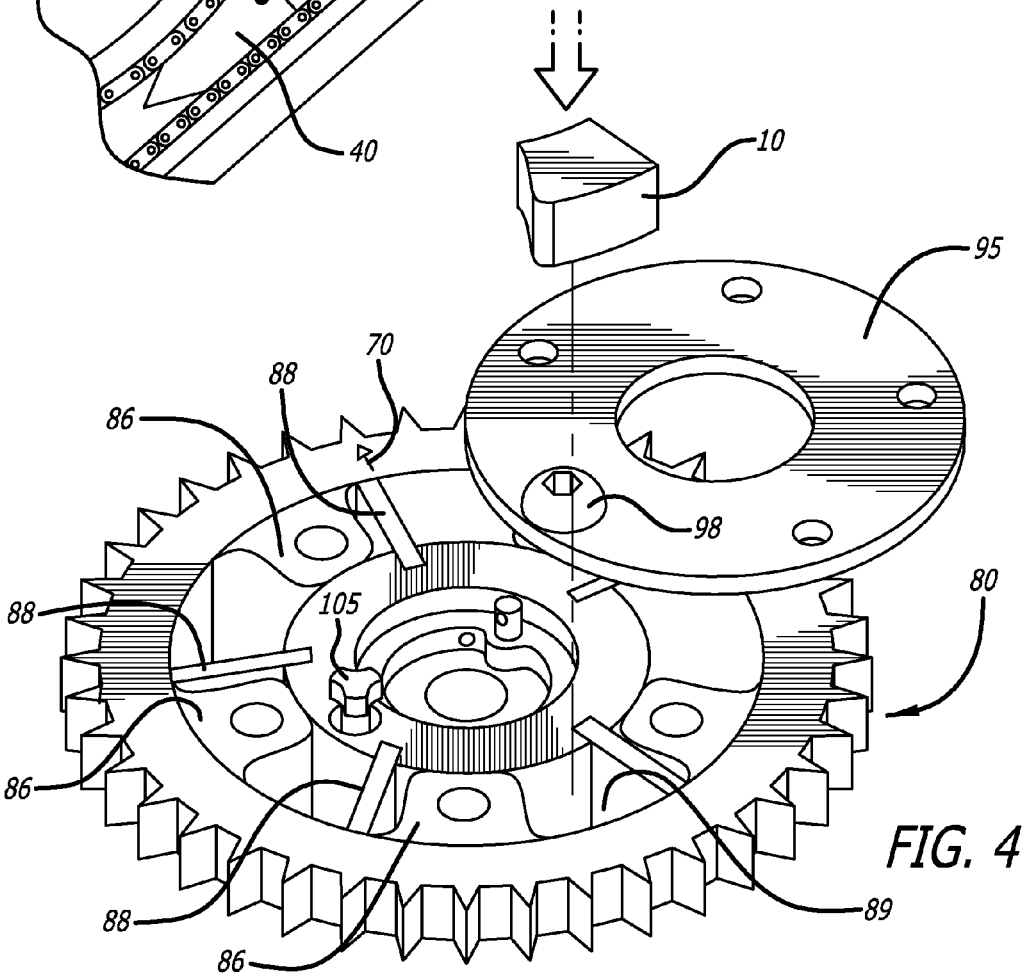
FIG. 4 is a perspective view, partially exploded, of the lockout and phaser.

The cover plate 95 is rotated on the remaining bolt 98 of the phaser 80, cautiously as there is a spring-loaded small check valve 105 that can be disconnected by release of the spring potential energy. Care is needed to prevent the valve 105 from dislodging from the phaser during this step (See FIG. 4). When the cover plate 95 is rotated away as shown in FIG. 4, the inner compartment of the phaser 80 is exposed showing five vanes 88 adjacent five lugs 86 within the compartment. Between adjacent lugs 86 and vanes 88 is a cavity 89, and the mechanical lockout 10 is sized to fit into this cavity and occupy the cavity with a snug fit. The lockouts 10 are precision machined to fit into a selected one cavity 89 better than the rest. Once the optimal cavity 89 is identified, the gear and lockout 10 will experience a slight preload that will resist movement of the lockout 10. Note that the invention will work with the lockout 10 in any of the cavities 89, but the tightest fit is preferred.

Once the lockout 10 is installed in the cavity 89 (FIG. 5), the cover plate is returned to its original position and the bolts are re-inserted and tightened, taking time to ensure that the check valve 105 is securing in place. The cover plate 95 is secured to the back on the gear. The gear is now re-installed back into the engine (FIG. 6). The first step is to slide the phaser 80 back in place under the timing chain 110, paying attention to make sure the alignment marks 70, 72 are aligned. Once the phaser 80 and chain 110 back in place and lined up one can slide the phaser back onto the front of the camshaft snout. If the camshaft 90 has moved after taking the phaser 80 off it may be necessary to spin the cam over slightly to get it to line up. Stock cams have a plug in the back of the cam that can be used with a ⅜" extension and ratchet to move the camshaft 90. Aftermarket cams usually have a hex built into the cam core itself for this purpose.

After returning the phaser 80 to the camshaft 90 and aligned, one can proceed to installing the bolt 30. It is important to ensure that the phaser 80 is fully seated on the cam snout and that the pin is engaged in the camshaft. Once the phaser bolt 30 in place, the wedge tool 40 can be withdrawn by pulling on the cord 42 to remove it from the engine. The next step will be torqueing the camshaft bolt 30. In order to torque the bolt 30, it may be necessary to utilize a second ratchet (preferably a breaker bar) installed on the crankshaft bolt to hold the engine from spinning over when the bolt is torqued. With the crankshaft held in position the camshaft phaser bolt 30 can be adequately torqued to its proper limit. After the camshaft bolt 30 is torqued the remaining components removed to begin the procedure can be reinstalled.

Figure 7:
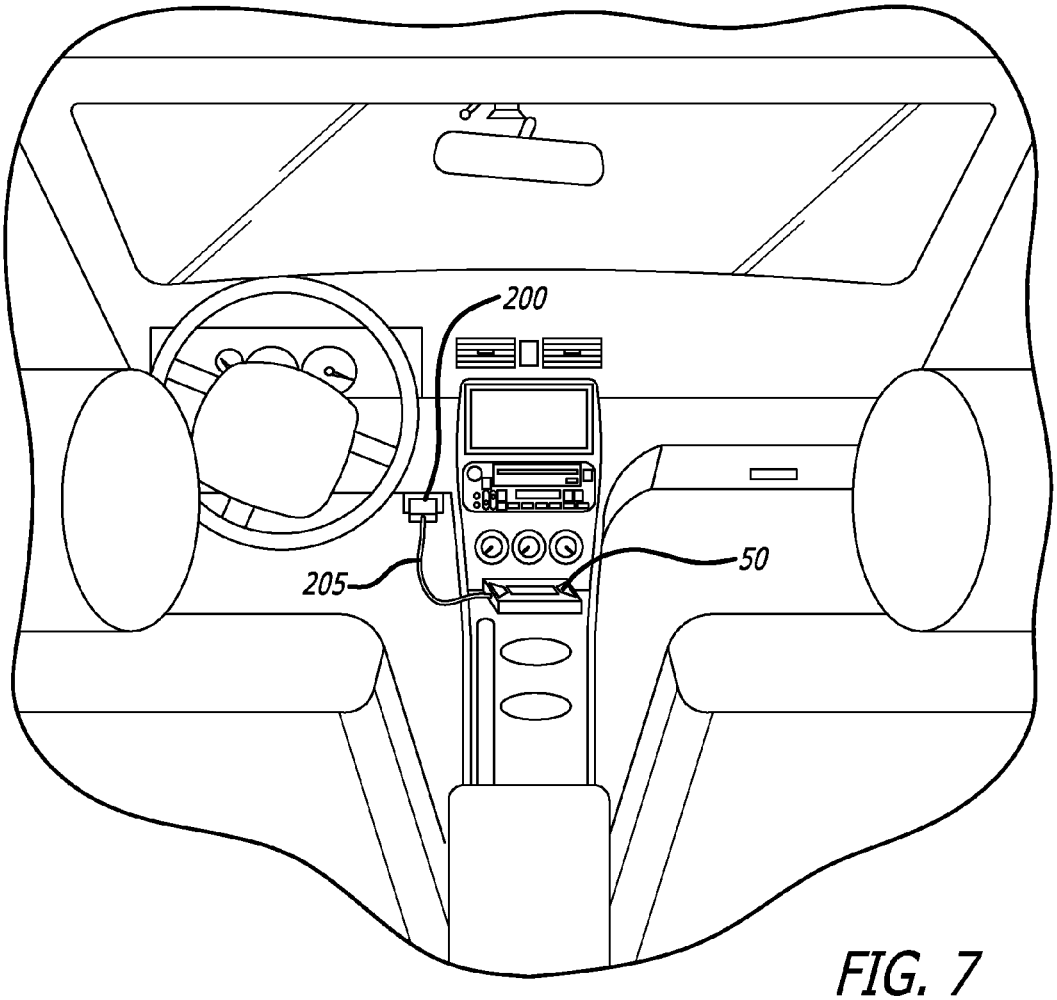
FIG. 7 is a perspective view of the coupling of the programmer with the engine control unit through the vehicle's dash.

To install the new timing data into the engine's ECU, the programmer 50 is plugged into the OBD-II port 200 (typically located beneath the steering column) with the engine off (FIG. 7). Ensure the cable 205 is securely connected and does not become disconnected during the session. The vehicle is placed in accessory mode by turning the key forward kept in that position until the procedure is complete. The display on the programmer 50 will produce prompts to transfer the data.

The components of the repair kit physically limit the camshaft phasing when installed. This limits the total travel rotation of the phaser which eliminates the failure of the phaser system and prevents possible engine damage. The vehicle's ECU is reflashed with the included programmer unit using an update application that allows for proper engine calibration with the limited range in camshaft phasing. The update server encrypts these files via a proprietary encryption scheme using an encryption key known only to the programmer and update server. The programmer decrypts the files with this key. The encryption key may be a dynamic random key that is regenerated each time the programmer establishes communications to the update server via the update application.

The kit includes a programmer unit 50 that is used in conjunction with the installation of the mechanical parts. The programmer unit 50 reads the installed factory calibration from the ECU, and then generates an altered calibration. The altered calibration adjusts the engine parameters to allow for the limitation of the camshaft phaser travel which prevents error codes and/or limited power mode(s) that would be associated with the limited camshaft phaser travel from the installed mechanical parts.

Example 1

The following calibration data is from a production file (AL3A-14C204-BJB) used in a 2009 Ford F-150 with the 5.4 L 3V SOHC V8 Engine.

Calibration Disclosure—Variable Camshaft Timing Hardware Disable

Purpose: Disables Camshaft Position System Performance diagnostics as camshaft phasing will be fixed with Repair Kit installed.

Ford Parameter Name: P0011SW

"VALUE: 02" change to "00"=disables DTC P0011

Purpose: Disables Mode6 reporting for VCT system as camshaft phasing will be fixed with Repair Kit installed, and data will be unnecessary or erroneous if reported.

Ford Parameter Name: TESTIDMAP_4

"VALUE: 110001101001" change to "110000001001"=disable VCT Mode6 reporting

Purpose: Disables VCT hardware configuration in ECU. Similar result to P0011SW alteration.

Ford Parameter Name: VCAMHP

"VALUE: 01" change to "00"=disables VCT hardware configuration

Purpose: Disables VCT configuration in ECU. Similar to VCAMHP alteration.

Ford Parameter Name: VCT_CONFIG

"VALUE: 03" change to "00"=disables VCT configuration

Purpose: Disables OBDII reporting for VCT system as camshaft phasing will be fixed with Repair Kit installed. Similar to P0011SW alteration.

Ford Parameter Name: VCT_OBDII_SW

"VALUE: 01" change to "00"=disables OBDII reporting for VCT.

Calibration Disclosure—Drivability Improvements/Engine Speed Limit Raised 100 RPM Purpose: Raised to prevent rev limit stutter on high mileage vehicles that have slower shifting transmissions.

Ford Parameter Names: ESL_CTL_LMT

"VALUE:5250" Add+100

Ford Parameter Name: NLMTHI_0

"VALUE:5700" Add+100

Additional spark advance (+1 deg)

Purpose: Raised to smooth engine running (NVH)

Ford Parameter Name: SPK_ADD

"VALUE: 0" Add+1

WOT Fuel delay set to zero

Purpose: Decreased to improve performance at wide open throttle.

Ford Parameter Name: FN 1311

| | RPM | | | | | | | | | |
|---|---|---|---|---|---|---|---|---|---|---|
| | 1000 | 1666.667 | 2333.333 | 3000 | 3500 | 3750 | 4000 | 4500 | 5000 | 5500 |
| 5 | 7 | 7 | 7 | 7 | 7 | 7 | 7 | 7 | 7 | 7 |
| 4 | 7 | 7 | 7 | 7 | 7 | 7 | 7 | 7 | 7 | 7 |

-continued

| | RPM | | | | | | | | | |
|---|---|---|---|---|---|---|---|---|---|---|
| | 1000 | 1666.667 | 2333.333 | 3000 | 3500 | 3750 | 4000 | 4500 | 5000 | 5500 |
| 3 | 7 | 7 | 7 | 7 | 7 | 7 | 7 | 7 | 7 | 7 |
| 2 | 4 | 4 | 4 | 4 | 4 | 4 | 4 | 4 | 4 | 4 |
| 1 | 0 | 0 | 0 | 0 | 0 | 0 | 0 | 0 | 0 | 0 |

All set=0

All set=0.

Desired Idle Speed raised 25 RPM

Purpose: Raised to smooth engine running at idle (NVH)

Ford Parameter Name: IS_DRBASE

"VALUE: 525" Add 25 RPM

Ford Parameter Name: IS_NUBASE

"VALUE: 600" Add 25 RPM

The forgoing description is intended to be illustrative but not limiting. The present invention is not limited to the foregoing descriptions and figures, but rather is intended to accompany and include any and all modifications and substitutions that would be recognized and apparent to one of ordinary skill in the art.

I claim:

1. A method for reducing noise in a vehicle engine comprising the steps of:

immobilizing a timing chain using a wedge tool;

matching a chain link with a tooth on a sprocket using a marking instrument to physically apply a mark on both the chain link and the tooth;

removing a cam shaft phaser from a cam shaft;

rotating a cover of the phaser away from an interior compartment to expose vanes therein;

placing a lockout component between one of said vanes and an adjacent lug to permanently fix the position of the vanes relative to an exterior point on the phaser during operation of the vehicle's engine, the lockout component sized to engage, and contemporaneously engaging both the one of said vanes and adjacent lug to prevent relative motion therebetween;

return the cover to its original position;

align the timing chain with the phaser according to the mark on the chain link and the tooth; and removing the wedge tool to release the timing chain.

2. The method for reducing noise of claim 1 wherein the wedge tool has a first side that is planar and a second side that is curved to conform with a set position between the timing chain.

3. The method for reducing noise of claim 1 wherein the wedge tool includes a tether that is used to retrieve the wedge tool from inside the engine.

4. The method for reducing noise of claim 1, wherein the lockout component is machined to fit snugly inside and wholly occlude a cavity formed between a vane and an adjacent lug.

5. The method for reducing noise of claim 1, further including the step of reconfiguring the engine's control unit based on a presence of the lockout mechanism in the phaser to account for a disabling of the phaser.

6. The method for reducing noise of claim 5, wherein the reconfiguring step is accomplished using a programmer that communicates with a remote server.

7. The method for reducing noise of claim 6, where the programmer is connected directly to the vehicle's data port.

8. The method for reducing noise of claim 6, wherein the remote server uses an encryption key with data for changing a timing of the engine.

9. The method for reducing noise of claim 8, wherein the encryption key is a dynamic key that changes each time the remote server communicates with the programmer.

* * * * *